United States Patent [19]

Hiroshi et al.

[11] Patent Number: 4,480,434

[45] Date of Patent: Nov. 6, 1984

[54] AIR NOZZLE FOR PROCESSING A FIBER BUNDLE

[75] Inventors: Niimi Hiroshi, Nagoya; Anahara Meiji, Kariya; Muramatsu Shigeru, Okazaki, all of Japan

[73] Assignees: Kabushiki Kaisha Toyoda Jidoshokki Seisakusho; Kabushiki Kaisha Toyota ChuoKenkyuscho, both of Aichi, Japan

[21] Appl. No.: 430,512

[22] Filed: Sep. 30, 1982

[30] Foreign Application Priority Data

Oct. 7, 1981 [JP] Japan ..... 56-158623

[51] Int. Cl.[3] ..... D02G 1/16

[52] U.S. Cl. ..... 57/333; 57/350; 57/908

[58] Field of Search ..... 57/332, 333, 350, 908

[56] References Cited

U.S. PATENT DOCUMENTS

| | | | |
|---|---|---|---|
| 2,100,588 | 11/1937 | Claus | 57/333 X |
| 2,302,790 | 11/1942 | Modigliani | 57/333 X |
| 3,458,987 | 8/1969 | Ozawa et al. | 57/333 X |
| 4,219,998 | 9/1980 | Farnhill | 57/333 X |

*Primary Examiner*—Donald Watkins

*Attorney, Agent, or Firm*—Burgess, Ryan & Wayne

[57] ABSTRACT

An improved air nozzle for processing a fiber bundle such as a staple fiber roving or a multifilament yarn. The air nozzle comprises a narrow channel and a wide channel in series, and part of the narrow channel protrudes into the inside of the wide channel so that a double tube is formed in the connecting portion thereof. Further, at least one jet is provided in the wide channel in the vicinity of the protruding end of the narrow channel. Due to this construction, no turbulence occurs in the wide channel during operation and an excellent sucking effect, as well as an excellent twisting effect, is obtained.

6 Claims, 7 Drawing Figures

AIR NOZZLE FOR PROCESSING A FIBER BUNDLE

BACKGROUND OF THE INVENTION

1. Field of the Invention

This invention relates to an improved air nozzle for processing a fiber bundle. More specifically, it relates to an air nozzle suitable for imparting a false twist to a fiber bundle, such as a staple fiber roving or a multifilament yarn. By imparting a false twist to a fiber bundle, part of the staple fibers composing the roving are entangled around a core portion of the roving to form a so-called "fasciated yarn", or, in the case of multifilament yarn, the yarn is texturized during false twisting with the aid of a heat treatment.

2. Prior Art Description

It is a fundamental function of an air nozzle to generate a vortex for twisting a fiber bundle and an auxiliary airstream for sucking the fiber bundle into a yarn passage provided within the air nozzle. An auxiliary airstream is especially very important for fasciated yarn spinning in which the fiber bundle is fed in a ribbon-like form to the air nozzle. Further it is necessary that both the main airstream and the auxiliary airstream be well-balanced so as not to generate a turbulence which may often interfere with the operations of the aforesaid airstreams.

In Japanese Examined patent publication (Kokoku) No. 36-10511, various types of air nozzles are disclosed. Each nozzle is provided with at least a jet, the axis of which is deviated from that of the yarn passage, with the result that a vortex occurs within the yarn passage. However, the nozzle lacks a sucking ability and is not suitable for fasciated yarn spinning.

In Japanese Examined patent publication (Kokoku) No. 50-95528, an air nozzle suitable for fasciated yarn spinning is disclosed in which a narrow channel and a wide channel are arranged in line with one another and are connected by an inclined and, further, are provided with inclined jets opening on the inclined wall. The above-mentioned nozzle has an improved function. However, there is a great difference in function among nozzles of this type because of the difference in the manufacturing accuracy thereof, this difference in manufacturing accuracy being due to the fact that it is very difficult to precisely bore a jet through an inclined wall.

Further, Japanese Unexamined patent publication (Kokai) No. 53-90433 discloses an air nozzle which comprises an inlet opening, an orifice, and a wide channel in series, the last two members being connected by an inclined wall and the wide channel having inclined jets opening in the downstream region of the inclined wall. The nozzle has a drawback in that the edge portion of the fiber bundle is disturbed due to a whirling turbulence within space between the orifice and the wide channel since the fiber bundle, after emerging from the orifice, has to pass through the aforesaid space prior to entering into the constant vortex caused by airstreams ejected from the jets.

SUMMARY OF THE INVENTION

It is an object of the present invention to provide an air nozzle which can generate a constant vortex as well as an auxiliary sucking airstream.

It is another object of the present invention to provide an air nozzle by which a fiber bundle is processed without being disturbed by turbulence generated between the narrow channel and the wide channel, the turbulence being due to a difference in diameter between the two channels, and which has stable operational characteristics irregardless of the accuracy of manufacture of the jet.

The above-mentioned objects are accomplished by an air nozzle comprising a body through which a narrow channel and a wide channel are pierced in series to form a yarn passage and at least one jet opening on the inner wall of the yarn passage, said air nozzle being characterized in that the inner end of the narrow channel protrudes from the inner end of the wide channel into the interior of the wide channel and in that the jet is inclined toward the outer end of the wide channel and opens in the vicinity of the inner end of narrow channel.

Further objects, features, and advantages of the invention will become more apparent from the following description, with reference to the accompanying drawings.

BRIEF DESCRIPTION OF THE DRAWINGS

In the drawings, the same reference numerals are used for the same or similar parts of all the embodiments.

DETAILED DESCRIPTION OF THE INVENTION

Figure 1:
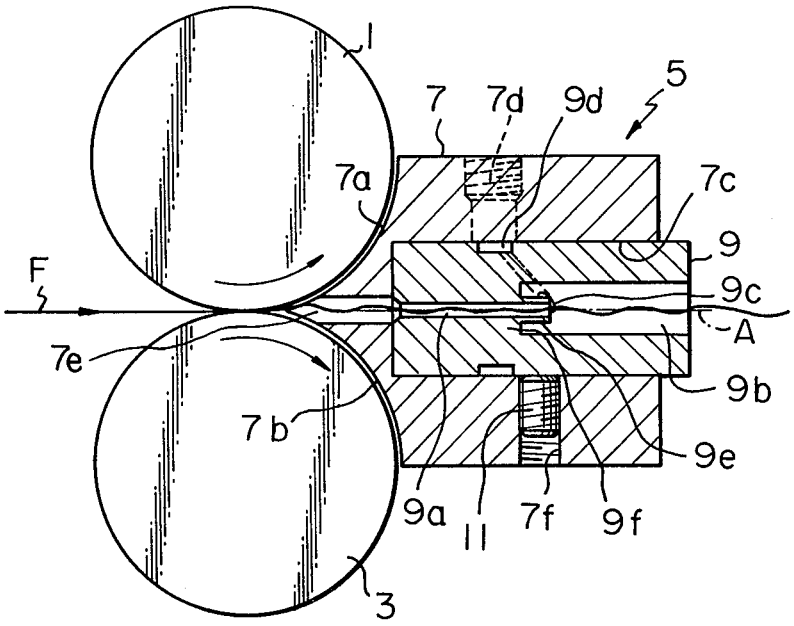
FIG. 1 is a side sectional view of an air nozzle according to the present invention.

In FIG. 1, a fiber bundle F such as a roving of staple fibers is nipped with a pair of feed rollers 1 and 3 and is delivered in a ribbon-like form to an air nozzle 5 according to the present invention.

The air nozzle 5 has a yarn passage running through its body 9 along its axis and at least a jet 9*c* surrounding the passage so that a vortex may occur within the passage when air from a high-pressure air source (not shown) is supplied to the jet 9*c*.

As the fiber bundle F introduced into the air nozzle 5 travels through the passage, a twist is imparted to it in the upstream region and thereafter the fiber bundle F is untwisted in the downstream region due to the false-twisting action of the vortex. Thereby, edge portion fibers are entangled around a core of the fiber bundle to form a fasciated yarn.

The air nozzle 5 consists of the aforementioned body 9 and a holder 7 for receiving the body 9. The holder 7 has concave front end walls 7*a* and 7*b* which confront and complement the surfaces of the feed rollers 1 and 3, respectively, and has a recess 7*c* for receiving the body 9. The holder 7 is provided with an air supply duct 7*d* extending from its outer wall to the recess 7*c* and with a fiber inlet 7*e* along its longitudinal axis.

The body 9 is provided with a narrow channel 9*a* and a wide channel 9*b*, both of which are arranged in series along a longitudinal axis of the body 9 and form the aforementioned yarn passage. The narrow channel 9*a* communicates at the outer end with the inlet 7*e* when the holder 7 and the body 9 are integrated.

Figure 2:
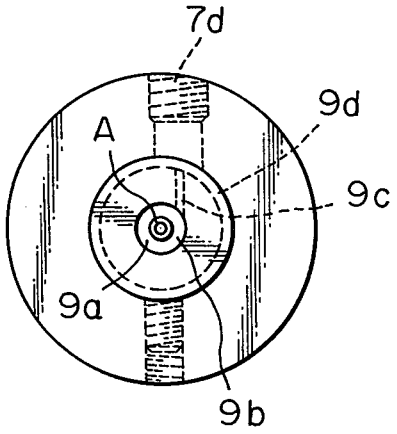
FIG. 2 is a view from the right side of the air nozzle illustrated in FIG. 1.

The inner end of the narrow channel 9a protrudes into interior of the wide channel 9b beyond the inner end of the wide channel 9b so that a double tube structure is formed in the vicinity of the border between the channels 9a and 9b. These two inner ends are connected by a tubular wall 9e. As shown in FIGS. 1 and 2, the jet 9c is pierced through the wall of the body 9 in such a manner that an image of the jet 9c projected onto a plane including an axis A of the wide channel 9b inclines toward the outer end of the wide channel 9b at an acute angle and another image of the jet 9c projected onto a plane perpendicular to the axis A forms a tangent to the circumference of the wide channel 9b. An outlet opening of the jet 9c is disposed in the vicinity of the inner end of the narrow channel 9a, and an inlet opening of the jet 9c communicates with an annular groove 9d provided on the outer wall of the body 9. The groove 9d communicates with the air supply duct 7d of the holder 7 when the body 9 is inserted into the recess 7c. The body 9 is fixed to the holder 7 with a set screw 11 engaged with a female screw 7f threaded through the wall of the holder 7.

In the above-mentioned air nozzle, an airstream ejected from the jet 9c into the wide channel 9b forms a main vortex whirling around the interior of the wide channel 9b and moving in the traveling direction of the fiber bundle (to the right in FIG. 1). The direction of the vortex depends on the deflection and inclination of the jet 9c to the axis A.

The vortex creates a lower pressure region in the vicinity of the inner end of the narrow channel 9a. Accordingly, air is sucked from the fiber inlet 7e and flows into the wide channel 9b through the narrow channel 9a. Due to the sucked airstream, the fiber bundle is conveyed from the feed rollers 1 and 3 to the wide channel 9b, where it is false twisted by the main vortex. The above-mentioned sucked airstream is referred to as an "auxiliary stream" hereinafter.

The effects of the main vortex and the auxiliary stream widely depend on the geometrical positioning of the jet 9c, especially the inclination relative to the axis A and the position of the outlet opening of the jet 9c. The essential points are as follows:

A. It is necessary that the jet 9c inclines toward the outer end of the wide channel 9b. If it does not incline toward the outer end of the wide channel 9b, the auxiliary stream impinges the main vortex, and, thereby, turbulence occurs in the vicinity of the inner end of the narrow channel 9a and disturbs the orientation of the edge portion fibers of the fiber bundle. Further, a counter flow caused by the turbulence may flow back into the interior of the narrow channel 9a, thereby lowering the sucking effect of the auxiliary stream.

B. It is preferred that at least a part of the outlet opening of the jet 9c be disposed between the inner end of the narrow channel 9a and the inner end of the wide channel 9b. This disposition is advantageous for generating a suitable auxiliary stream. The length of the portion of the narrow channel 9a protruding into the wide channel 9b should be as short as possible provided the position of the outlet opening of the jet 9c satisfies the aforesaid desirable conditions since excessive protrusion of the portion of the narrow channel 9a into the wide channel 9b results in a wasted space in the air nozzle.

C. The jet 9c may be disposed between the inner end of the narrow channel 9a and the outer end of the wide channel 9b. However, the distance between the jet 9c and the inner end of the wide channel 9b is preferably less than six times the jet diameter to avoid turbulence.

In connection with this, the "distance" means the distance between the images of the inner end of the wide channel 9b and the intersecting point of the jet axis and the axis A, the images being projected onto a plane including the axis A, and the "diameter" of the jet 9c means the diameter of a cross-section of the jet 9c along a plane perpendicular to the jet axis.

D. In general, the inclination of the jet 9c toward the axis A is preferably not more than 60°, more preferably not more than 50°. If the inclination of the jet exceeds the above-mentioned range, part of the main vortex may blow back into the narrow channel 9a.

However, it should be understood that the values may considerably vary in response to the diameter of the jet 9c and the air pressure supplied to the jet.

Figure 3:
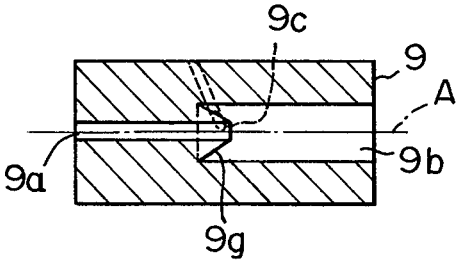
FIG. 3 is a side sectional view of the body of another air nozzle according to the present invention.

FIG. 3 shows a second embodiment of the air nozzle body 9 according to the present invention.

Figure 4:
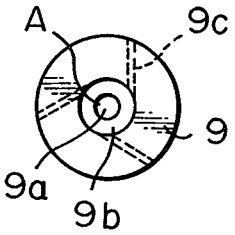
FIG. 4 is a frontal view of the body illustrated in FIG. 3.

In the second embodiment, the inner end of the narrow channel 9a is connected to the inner end of the wide channel 9b by means of a sloped wall, such as a conical wall 9g. This structure effectively faciliates forwarding of the main vortex to the downstream region. The wall 9g may be a hyperboloid or a paraboloid. Further, the second embodiment has a plurality of jets 9c arranged equidistantly around the axis A for strengthening the vortex, as shown in FIG. 4. The number of jets 9c is preferably more than three.

Figure 5:
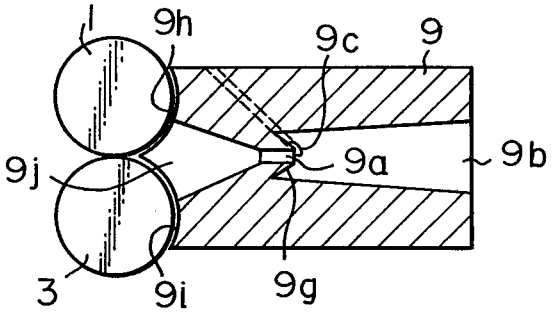
FIGS. 5 to 7 are side sectional views of other air nozzles according to the present invention.

FIG. 5 illustrates a third embodiment of the air nozzle body 9 according to the present invention, the body 9 being formed of only one block and being especially suitable for fasciated yarn spinning. The body 9 has concave front end walls 9h and 9i to confront and complement the surfaces of the feed rollers 1 and 3. Between the front end walls 9h and 9i is provided a conical shaped inlet recess 9j which converges toward the downstream region and which is connected to the narrow channel 9a. The inlet recess 9j is suitable for receiving a fiber bundle spread widely due to the drafting action of the feed rollers 1 and 3. The narrow channel 9a functions to regulate the traveling position of the fiber bundle, and the inner diameter of the narrow channel should be large enough so that it does not become clogged with dust or neps contained in the fiber bundle. A suitable inner diameter is in a range of from 1.5 to 4 mm.

The inner end of the narrow channel 9a protrudes into the interior of the wide channel 9b, being similar to the first or second embodiment. Both of the inner ends of the channels 9a and 9b are connected by the conical wall 9g. The wide channel 9b gradually diverges toward the downstream region.

The fiber bundle introduced into the air nozzle body 9 from the feed rollers 1 and 3 is subjected to the action of the vortex ejected from a jet 9c opening in the vicinity of the inner end of the narrow channel 9a and is twisted to form a fasciated yarn. In this embodiment, since the auxiliary stream is strong, the fibers in the supplied fiber bundle can be fully sucked into the narrow channel 9a without being scattered and lost.

Figure 6:
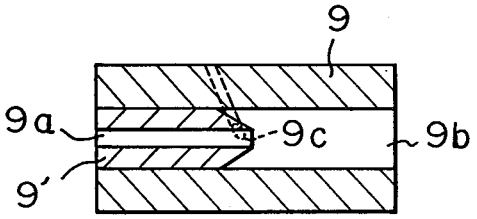
Figure 7:
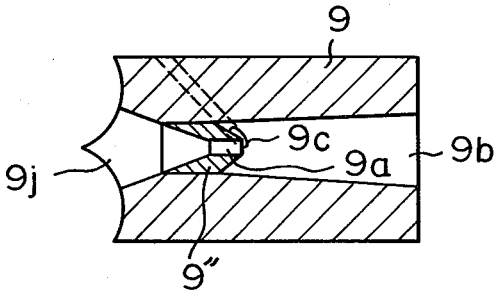

In FIGS. 6 and 7 are illustrated fourth and fifth embodiments, each of which is integrated with a separate member for the narrow channel 9a and the body 9 with a screw or by pressing. The structure of the finished nozzles of these embodiments are substantially the same as those of the second and third embodiments shown in FIGS. 3 and 5, respectively. Due to this separate type of structure, the narrow channel 9*a* can be machined precisely and easily.

The air nozzles illustrated in FIGS. 1 and 3 can be utilized in a reverse position, namely, the wide channel can be positioned in the upstream region and the narrow channel can be positioned in the downstream region. This positioning is suitable for texturizing a multifilament yarn in which a considerable tension is required during processing.

We claim:

1. An air nozzle for processing a fiber bundle comprising a body having a narrow channel and a wide channel in series to form a yarn passage, each having an inner and outer end, and at least one jet opening on an inner wall of said wide channel, said air nozzle being characterized in that the inner end of said narrow channel protrudes from the inner end of said wide channel into the interior of said wide channel, and said jet is inclined to an axis of said wide channel toward the outer end of said wide channel and opens in the vicinity of said inner end of said narrow channel, said wide channel having a circular cross-section, the diameter of said circular cross-section of said wide channel along its length being at least as large as the diameter at its inner end.

2. An air nozzle according to claim 1, characterized in that said inner end of said narrow channel and said inner end of said wide channel are connected by a sloped wall.

3. An air nozzle according to claim 1 or 2, characterized in that said body comprises a plurality of said jets.

4. An air nozzle according to claim 1 or 2, characterized in that said body is inserted with a separate member provided with said narrow channel.

5. An air nozzle according to claim 1 or 2, characterized in that the distance between said jet and said inner end of said wide channel is less than six times the diameter of said jet.

6. An air nozzle according to claim 1 or 2, wherein the diameter of said wide channel gradually increases toward the outer end of the wide channel.

* * * * *